United States Patent [19]

Martin et al.

[11] 4,363,277

[45] Dec. 14, 1982

[54] STABILIZING HIGH SPEED RAILWAY TRUCK SAFETY DEVICE

[75] Inventors: Henry Martin, Hamilton; Charles R. Thompson, Lynden, both of Canada

[73] Assignee: Dofasco Inc., Hamilton, Canada

[21] Appl. No.: 149,367

[22] Filed: May 13, 1980

[51] Int. Cl.[3] ..... B61F 3/08; B61F 5/20; B61F 5/24

[52] U.S. Cl. ..... 105/201; 105/164; 105/171; 105/190 R; 105/199 A; 105/199 R; 105/210

[58] Field of Search ..... 105/164, 185, 171, 190 R, 105/199 A, 199 R, 201, 210, 165

[56] References Cited

U.S. PATENT DOCUMENTS

| | | | |
|---|---|---|---|
| 3,628,465 | 12/1971 | Dobson et al. | 105/164 X |
| 3,636,886 | 1/1972 | Lich | 105/164 |
| 3,704,670 | 12/1972 | Dobson et al. | 105/164 X |
| 3,717,104 | 2/1973 | Lawler et al. | 105/164 |
| 3,906,869 | 9/1975 | Dobson et al. | 105/199 A |
| 3,970,009 | 7/1976 | Schultz | 105/199 R |

FOREIGN PATENT DOCUMENTS

| | | | |
|---|---|---|---|
| 2145747 | 3/1973 | Fed. Rep. of Germany | 105/164 |
| 2252616 | 8/1973 | Fed. Rep. of Germany | 105/164 |
| 480968 | 12/1969 | Switzerland | 105/164 |
| 1379059 | 1/1975 | United Kingdom | 105/164 |

*Primary Examiner*—Robert B. Reeves
*Assistant Examiner*—Howard Beltran
*Attorney, Agent, or Firm*—Hirons, Rogers & Scott

[57] ABSTRACT

A safety device for a banking vehicle includes a pair of cylinders which extend to hold the superstructure in an upright position. The cylinders are hydraulically connected to an accumulator which provides a pressurized fluid reservoir. A valve controls flow from the accumulator to the cylinders. Upon detection of a failure in one of the vehicle systems the valve moves to a position in which fluid flows from the accumulator to extend the cylinders. A pilot operated check valve is positioned between the accumulator and the cylinders to hold the cylinders in the extended position until the failure is rectified.

11 Claims, 7 Drawing Figures

STABILIZING HIGH SPEED RAILWAY TRUCK SAFETY DEVICE

This invention is concerned with a safety device for banking vehicles, such as railway vehicles, and especially but not exclusively for such vehicles intended for use in high speed railway passenger cars.

It is a continuing requirement for railway vehicles, particularly passenger cars, to achieve higher speeds combined with a safe, comfortable ride, and to this end a number of proposals have been made hitherto to bank the cars by tilting about a longitudinal axis, thereby reducing the lateral force applied to passengers, and permitting higher speeds of operation. There have been disclosed in U.S. Pat. Nos. 3,628,465 and 3,704,670 issued Dec. 21, 1971 and Dec. 5, 1972 respectively, and assigned to Dominion Foundries and Steel Limited, different railway truck constructions whereby a car body mounted thereon can be tilted under the control of fluid-operated motors, specifically liquid-operated motors. These constructions provide, as far as possible, that the structure and components used in the trucks are the same or very closely similar to those of previously existing vehicles, so that the servicing and maintenance thereof can readily be accomplished with existing railway equipment, shop skills and personnel.

One problem that must be anticipated in any vehicle, and fail-safe arrangements provided therefor, is the partial or total failure of the power supplies. A special problem with a banking vehicle is that such failure may take place while it is in a banked condition. If the vehicle becomes locked in that condition problems will arise with passenger comfort as the vehicle continues. A dangerous condition may arise if one truck of a car is locked in position and the other is not. It is therefore desirable to provide some positive means that will always be effective to prevent uncontrolled tilting of the truck body upon such failure.

In U.S. Pat. No. 3,906,869 issued Sept. 23, 1975 and assigned to Dominion Foundries and Steel Limited, there is disclosed a device which will be effective to prevent such uncontrolled tilting. A pair of abutments are slidably mounted on the frame are biased by a coil spring to a position in which they engage the bolster to prevent tilting movement relative to the frame. The force of the coil spring is opposed by a pair of hydraulic cylinders which, when pressurized, act to compress the coil spring and move the abutments away from the bolster. Upon loss of pressure due to failure of the power source or a leak, or upon detection of improper operation of the electrical controls, the coil spring moves the abutments into engagement with the bolster.

The above arrangement has proved successful in avoiding the potentially hazardous situation associated with the prior art. However, since space is at a premium there is a continuing requirement to arrange the components in a simple and compact manner so that the space occupied within the truck is reduced to a minimum.

According to the present invention there is provided for use in a railway truck assembly having a bolster tiltable relative to a frame, a control circuit for hydraulic motor means operable between a first condition in which tilting of the bolster relative to a truck frame is inhibited and a second condition in which the tilting is permitted, the control circuit comprising a pressure line connected to a source of pressurized fluid, a return line connected to a sump for the pressurized fluid, a pair of hydraulic service lines connected to opposite sides of the hydraulic motor means, valve means connected to the service lines and the pressure and return lines and operable in a first position to direct fluid from the pressure line to one of the service lines to move the motor means to the first condition and in a second position to direct fluid from the pressure line to an other of the service lines to cause the motor means to move to the second condition, control means to move the valve means between the first and second positions, and a pressurized fluid reservoir connected to the pressure line and operable to supply pressurized fluid to the valve means whereby, upon movement of the valve means to the first position, the pressurized fluid reservoir supplies fluid to the one service line to move the motor means to the first condition.

The provision of a pressurized fluid reservoir, which is preferably a variable volume accumulator, ensures that pressurized fluid is available to move the motor means upon failure of the pressure source. The accumulator therefore acts as a selectively operable biasing means which is controlled by the valve means. Locking of the motor means in the first position may be achieved by a check valve located in the one service line which prevents flow out of the motor. Pilot operation of the check valve is utilized to permit such flow when it is desired to move the motor means to the second position.

A particular preferred embodiment of the invention will now be described, by way of example only, with reference to the accompanying diagrammatic drawings, wherein FIG. 1 is a perspective view of a railway car supported on a pair of railway trucks;

FIG. 2 is an exploded perspective view of one of the railway trucks shown in FIG. 1 with the parts thereof shown displaced vertically relative to one another for clarity of illustration;

FIG. 2*a* is a perspective view of a detail of FIG. 2 that cannot be seen clearly in that figure;

Figure 1:
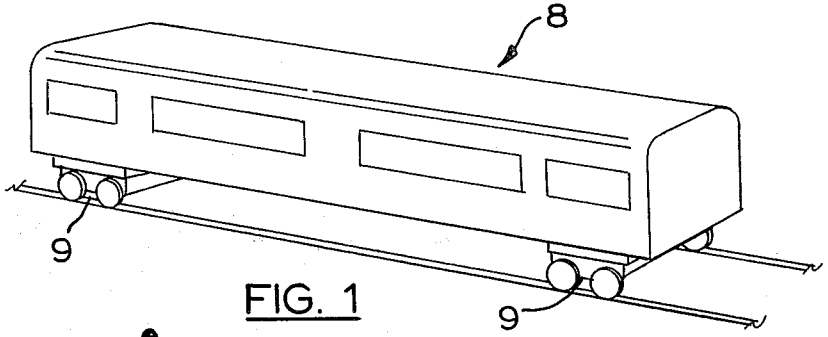

Referring now to FIGS. 1 to 5 a railway car 8 is supported on a pair of spaced trucks 9 each having four wheels and intended for use at high speeds. Each truck 9 includes a frame comprising two parallel side frame members 10 and 12. The members have their centre portions depressed, and are connected to one another intermediate their ends by a single central massive transom 14. The truck 9 runs on two similar wheel and axle assemblies, each constituted by a respective axle 16 and pair of wheels 18. The truck is of course provided with conventional brakes (which are not shown) and may be a motorized unit, in which case each axle will, for example, be driven by a respective electric motor and gear unit (not illustrated) mounted on the frame and operatively connected to the respective axle. The manner in which such motor and gear units (when provided) and the brake units can be mounted in the frame will be apparent to those skilled in the art.

Each axle 16 is rotatably mounted in the frame by a respective pair of journals 20, each of which is mounted and guided for the necessary generally vertical movement by two resilient suspension units 22. The car body that is to be mounted on the truck is indicated diagrammatically as a floor member 24 (FIGS. 3 and 5), having downwardly extending bracket members (FIG. 3) fastened to the underside thereof on either side adjacent each truck. Bolster means for mounting the body on the truck frame comprise lower and upper bolster members 28 and 30 respectively, the lower bolster member 28 being connected to the side frames by a link suspension system, while the upper bolster member 30 is pivotally connected to the lower bolster member and in turn supports the vehicle body 24 via massive laterally-spaced air springs 32.

In this particular embodiment the means pivotally connecting the two bolster members comprise four resilient suspension units 34, disposed at the four corners of a rectangle with their longitudinal compression axes generally vertical. The center portion of the lower bolster is provided with an upwardly extending spigot 36 that extends into an aperture 38 in the upper bolster 30. In some embodiments it may be preferred to mount the spigot 36 on the upper bolster and have it enter into a corresponding aperture in the lower bolster. The spigot 36 is mounted in the aperture 38 by two opposed longitudinally spaced resilient suspension units 40; stop members 42 are provided and are engaged by the spigot upon its extreme transverse motion.

Each end of the lower member 28 is connected to the respective truck side frame by an articulated linkage comprising a generally Y-shaped link member 44, which is operative as a bell-crank lever and is pivoted to upstanding lugs 46 on the frame about its crank pivot axis by a pivot axis by a pivot rod 48. The end of one crank arm of the link member 44 is connected by a pivot rod 50 to the adjacent ends of a bifurcated link 52, the other ends of the link 52 being connected by a pivot 54 to lugs 56 extending from the bolster member 28. The ends of the other crank arms of the Y link members 44 are connected by pivot rods 58 to the respective ends of a connecting link 60. The articulated linkage is completed by a depending link 62 (FIG. 2*a*) fixed rigidly at its upper end to the central portion of bolster member 28 and pivoted at its lower end by a rod 64 to one end of a short transverse link 66 that is disposed generally parallel to the connecting link 60 and is accomodated in a recess therein. The other end of the transverse link 66 is connected to the link 60 by a pivot rod 68.

The required rolling or tilting motion of the two bolster parts relative to the frame is produced under the control of first motor means 70 comprising two double acting hydraulic units 70*a*, 70*b* which are disposed one on each side of the bolster. Each unit 70*a*, 70*b* is pivotally connected at 72 to the frame and at 74 to the lower member 28. Solid links 76 (FIG. 2) are connected by spherical rubber bushings to the upper bolster 30 and to the brackets 26 fastened to the car floor, while damper units 78 are pivotally connected between the two bolster members.

The action of the connecting linkage is permitting tilting of the bolster member and of the vehicle body mounted thereon will be apparent to those skilled in the art. A detailed description appears in the above identified U.S. patents, the teachings of which are incorporated herein by reference. However, to ensure a full and complete understanding of the present invention the operation of the connecting linkage will be briefly described, assuming that the body is to be tilted counter clockwise with respect to the frame 12 when viewed in FIG. 3. Pressure fluid is directed to the first motor means 7*a*, 70*b* by a control circuit described below to cause extension of hydraulic unit 70*a* and retraction of hydraulic unit 70*b*. The lower member 28 moves to the right to exert a lateral force through transverse link 66 to the connecting link 60. The Y-shaped links 44 will rotate counter clockwise about the pivot pins 48 and act through respective links 52 to rotate the lower member 28 counter clockwise. Since the bolster member 30 is carried by the four pads 34, it will also tilt counter clockwise and move the car body into a banked condition. The body will be held in this condition until flow to the motor means is reversed to move the lower member 28 to the left so that the linkage operates to move the car back to an upright condition.

Figure 6:
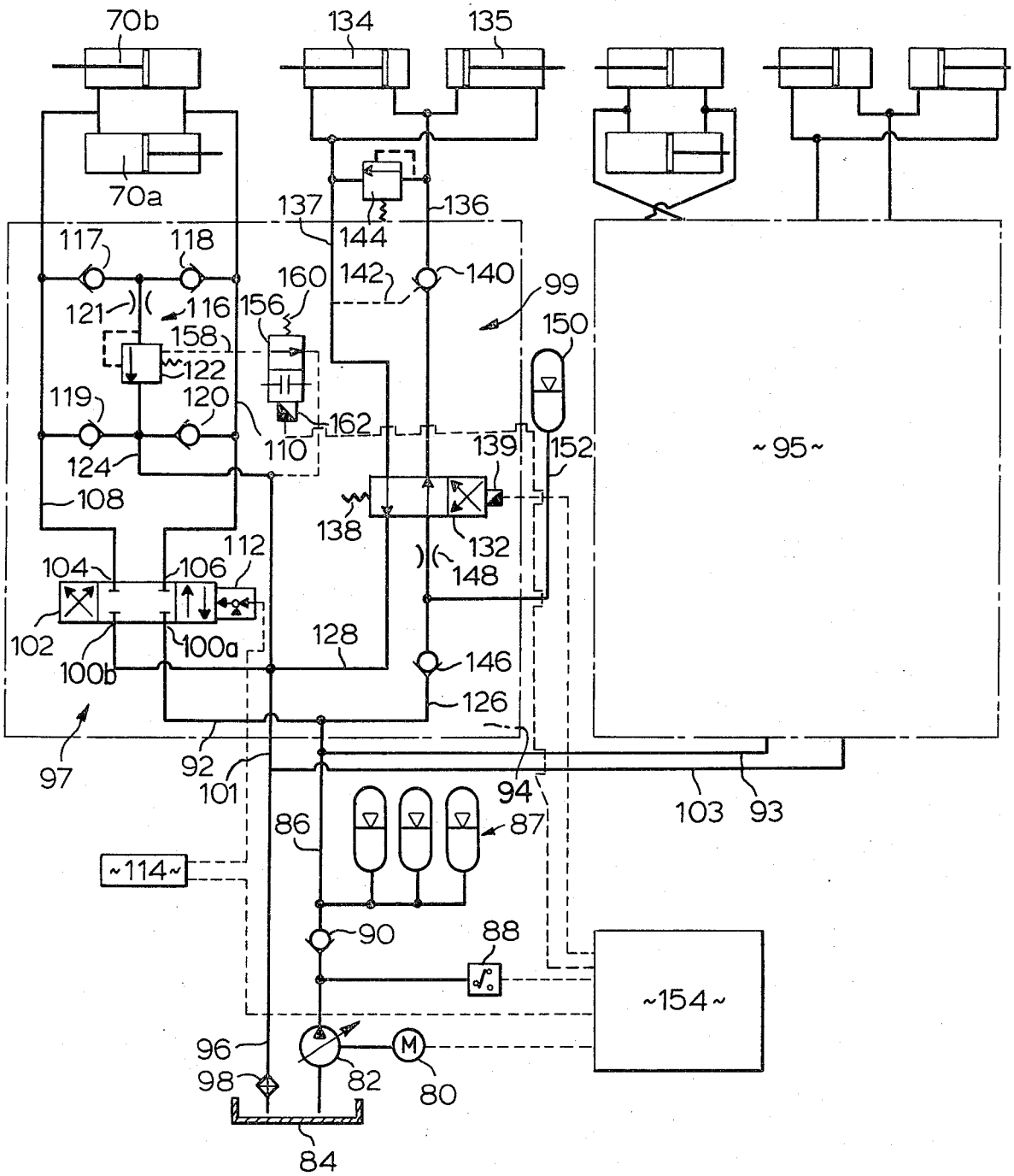
FIG. 6 is a schematic diagram of the electrical and hydraulic operating system for the truck and safety device motors.

The tilting of the car body is controlled by the electrical and hydraulic circuit shown in FIG. 6. An electrically driven motor 80 drives a variable displacement hydraulic pump 82 which receives fluid from a sump 84 and delivers it to a pressure line 86. A pressure sensing device 88 is connected in the pressure line 86 to sense the pressure delivered by the pump 82 and generate an electrical signal should the pressure drop below a predetermined value. Accumulators 87 are also hydraulically connected to the pressure line 86 to provide a reservoir of pressurized hydraulic fluid and reduce pressure surges in the circuit. The pressure line 86 is connected through a check valve 90 to a pair of branch conduits 92,93 which respectively supply a pair of manifolds 94, 95. Hydraulic fluid from the manifolds 94, 95 is returned to the sump 84 through conduits 101, 103 and return conduit 96 which includes a filter assembly 98. Each of the manifolds 94, 95 includes identical hydraulic components and each is associated with a respective one of the trucks 9. Since the manifolds 94, 95 are identical only one has been shown in detail and will be described herein. The manifold 94 includes a tilt circuit 97 and a safety circuit 99 which are connected in parallel to the branch conduit 92 and conduit 101. To service the tilt circuit, the branch conduit 92 and conduit 101 are connected respectively to an inlet port 100*a* and return port 100*b* of an electro-hydraulic proportional servo valve 102. The valve 102 has a pair of outlet ports 104, 106 to which are connected tilt lines 108, 110 respectively. The tilt line 108 is connected to the head end of the hydraulic unit 70*a* and rod end of hydraulic unit 70*b*. The tilt line 110 is connected to the rod end of the hydraulic means 70*a* and the head end of unit 70*b*. If the valve 102 is maintained in a neutral position the tilt lines are sealed so that the motor means 70*a* and 70*b* are fixed. The valve 102 may be moved to a first position in which the branch conduit 92 is connected to the tilt line 108 and the conduit 101 connected to the conduit 110. The hydraulic unit 70*a* will thus extend and cause anticlockwise tilting of the car body 24 in the manner described above. Similarly, the valve 102 may be moved to a second position to connect the branch conduit 92 to the tilt line 110 and the conduit 101 to the tilt line 108 to produce clockwise tilting of the body. The valve 102 is controlled by a servo device 112 which is regulated by an accelerometer control 114. The accelerometer senses lateral acceleration of the railway car 8 and generates a signal to the servo 112. The servo device 112 responds to move the valve 102 in the desired tilting direction and in proportion to the magnitude of the signal received from the accelerometer 114. The movement of the valve 102 is thus proportional to the lateral acceleration to produce a proportional tilting of the car 8.

The tilt lines 108, 110 are protected against excessive pressure and cavitation by crossover relief and check valve assembly 116 which includes four check valves 117, 118, 119, 120 and a pressure relief valve 122. The check valves 117, 118 permit flow from the lines 108, 110 to the relief valve through a choke 121 whereas the valves 119, 120 permit flow to the tilt lines 108, 110 from a relief line 124 connected to the conduit 101 and the return conduit 96. In this manner, whichever of the lines 108, 110 is at the higher pressure is serviced through one of the check valves 117, 118 by the relief valve 122 and any flow through the relief valve 122 is directed through relief line 124 and one of the other check valves 119, 120 to the opposite side of the first motor means 70*a* and 70*b*.

The setting of the relief valve 122 is regulated by a two position control valve 156 which forms part of the safety circuit 99. The control valve 156 controls flow through a drain line 158 connected between the valve 122 and the drain line 101. The valve 156 is biased by a spring 160 to a first position in which flow through the valve 156 is permitted. In this position, the relief valve 122 will open at a very low nominal pressure so that there is free flow across the first motor means units 70*a* and 70*b* through the crossover relief and check valve assembly 116. This permits the car 8 to tilt freely relative to the truck 9. A solenoid 162 operates when energized to move the valve 156 against the spring 160 to a second position in which flow through the line 158 is prevented. When the valve 156 is in the second position fluid trapped between the valve 122 and valve 156 acts to set the relief valve 122 at a higher pressure, typically in the order of 2,300 p.s.i. In this condition under normal operating conditions, flow between the tilt lines 108, 110 is prevented.

The safety circuit includes a two position directional valve 132 which controls flow from the branch conduit 92 through pressure conduit 126 to a pair of safety cylinders 134, 135. The cylinders 134, 135 are connected to the valve 132 by service lines 136, 137 so that when the valve 132 is in a first position it connects the pressure conduit 126 to the service line 136 to cause extension of the cylinders 134, 135. In this first position flow from the cylinders 134, 135 is returned to sump 84 through service line 137 which is connected by valve 132 to a drain line 128 communicating with conduit 101 and return line 96.

Figure 5:
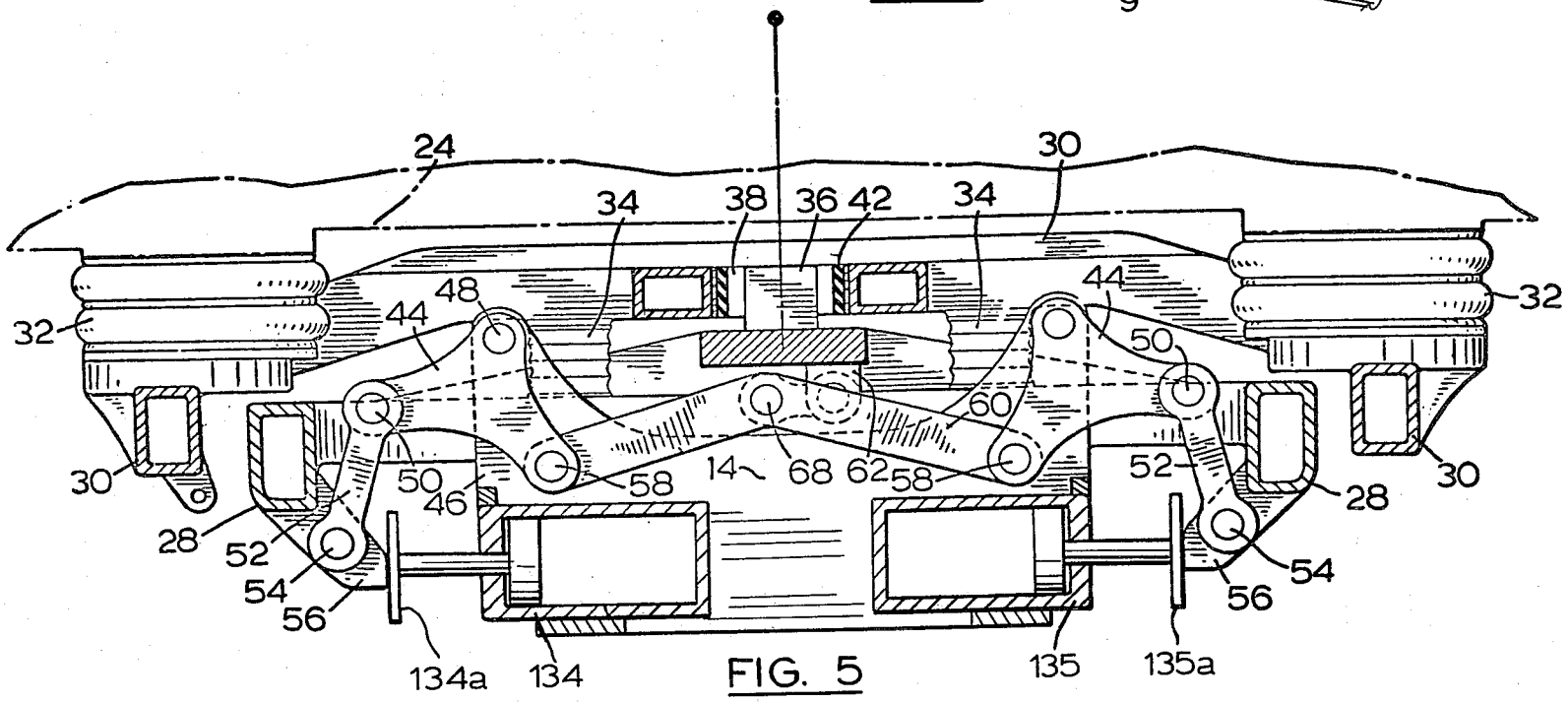
FIG. 5 is a section similar to FIG. 3 and showing the safety device in an extended operative position.

As can best be seen in FIGS. 2 to 5, the cylinders 134, 135 are mounted on the frame 12 in alignment with lugs 56 on the lower member 28. With the cylinders 134, 135 retracted, a clearance is provided between the lugs 56 and the frame 12 to permit the desired tilting action. The stroke of the cylinders 134, 135 is chosen so that when extended, as shown in FIG. 5, pads 134*a*, 135*a* are positioned to engage the lugs 56 when the lower member is in a generally horizontal position.

The valve 132 is biased to the first position by a spring 138 and is moved by a solenoid 139 to a second position in which the pressure conduit 126 is connected to service line 137 and drain line 128 is connected to service line 137. The service line 136 includes a check valve 140 which normally prevents flow from the head end of cylinders 134, 135. In order to permit the cylinders 134, 135 to be retracted when the valve 132 is in the second position, a pilot line 142 is connected between the service line 137 and the check valve 140 so that pressurized fluid in the line 137 will open the check valve and allow fluid to flow to drain conduit 128. The line 136 also includes a relief valve 144 between the check valve 140 and the cylinders 134, 135 to relieve excessive pressures in the head end of the cylinders.

An accumulator 150 is connected by a conduit 152 to the pressure conduit 126 intermediate the check valve 146 and throttle 148 and serves as a pressurized fluid reservoir. The accumulator 150 is precharged with nitrogen gas and constitutes a variable volume reservoir. Delivery of pressurized hydraulic fluid through the conduit 152 will compress the gas in the accumulator and increase the volume of hydraulic fluid stored by the accumulator. Similarly a reduction of hydraulic pressure will allow the gas to expand and expel hydraulic fluid from the accumulator.

The pressure conduit 126 incorporates a check valve 146 to prevent flow from the accumulator 150 to the branch conduit 92 and a throttle 148 to regulate the rate of flow through the valve 132 to the cylinders 134 and 135.

A control centre 154 controls electrical power supply to the motor 80, the servo device 112, and the solenoids 139, 162 in accordance with signals received from a number of sensors. These sensors include the pressure sensing device 88, a pressure differential sensing device to detect variations in pressure in the first motor means units 70*a* and 70*b* of the trucks 9, and a thermostat to detect abnormal temperatures, an electric power supply monitor although additional sensors may be utilized if desired.

Under normal operating conditions, the control centre 154 directs power to the motor 80, the servo device 112 and the solenoids 139, 162. The pump 82 thus supplies pressurized fluid to the tilt and safety circuits and the valve 156 is moved to set the relief valve 122 to the higher relief pressure. The valve 132 is moved by the solenoid 139 to its second position so that pressurized fluid is directed to the line 137 to open the check valve 140 and retract the cylinders 134, 135. The pilot operation of the check valve 140 ensures that pressurized fluid is available before flow out of the head end of the cylinders 134, 135 is permitted. The accelerometer 114 will thus control movement of the proportional servo valve 102 and direct fluid as required to produce the desired tilting movement.

Upon detection of an abnormal condition by one of the sensors, for example, a pressure loss detected by the sensor 88, the control centre will cut the power supply to the motor 80, servo device 112 and solenoids 139, 162. The valve 156 will be moved by the spring 160 to its first position to open the conduit 158 and reduce the pressure setting of the relief valve 122.

Hydraulic fluid is free to move across the motor means units 70*a* and 70*b* through the cross over relief and check valve assembly 116 to permit movement of the car relative to the truck 9. The choke 121 controls the rate of such morement.

At the same time, the valve 132 will be moved by the spring 138 to connect the conduit 126 with the service line 136. Fluid will be expelled from the accumulator 150 through the line 152 and into the head end of the cylinders 134, 135. The check valve 146 prevents flow from the accumulator 150 to the sump so that the cylinders 134, 135 extend at a rate controlled by the throttle 148.

Figure 2:
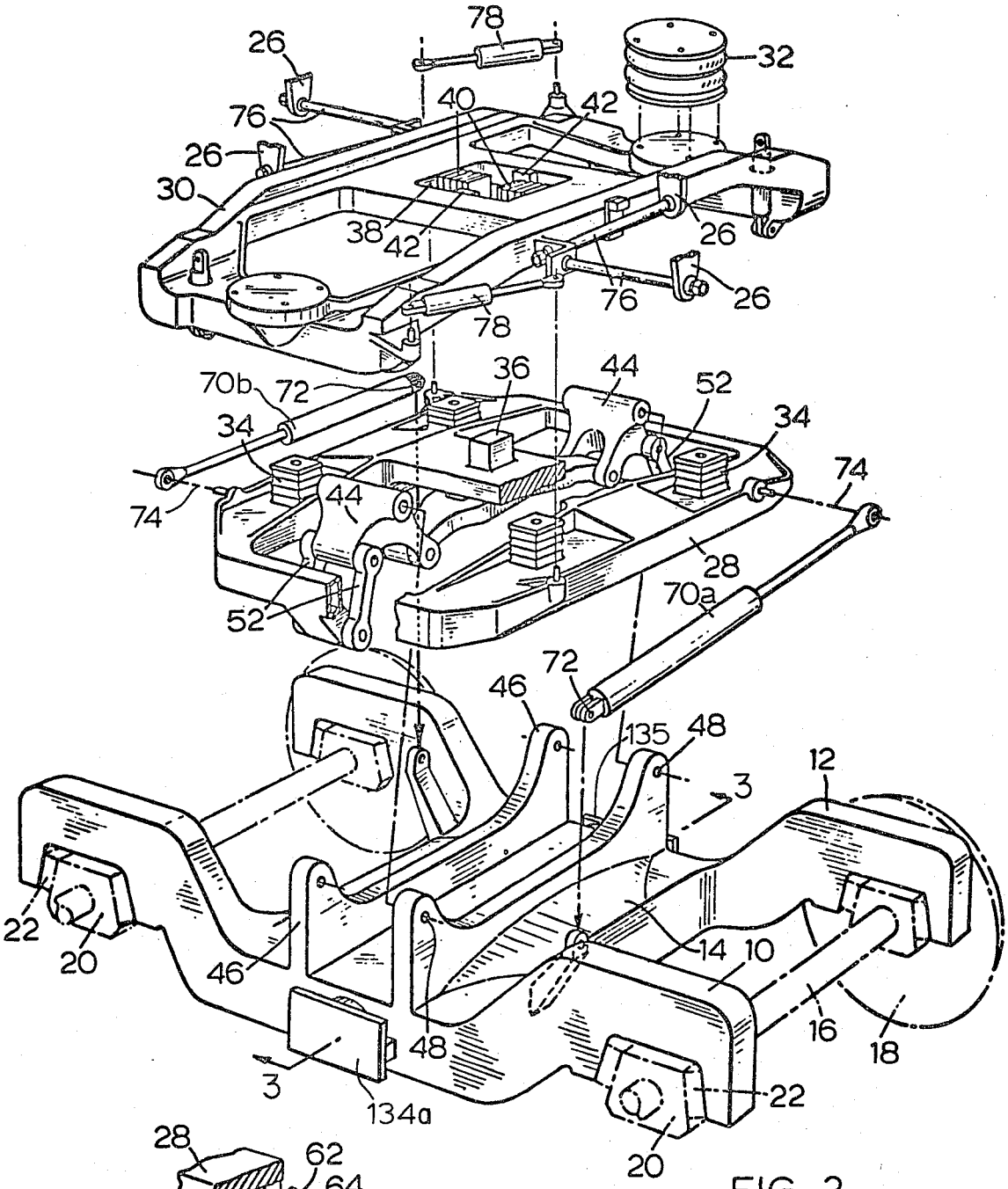
Figure 2A:
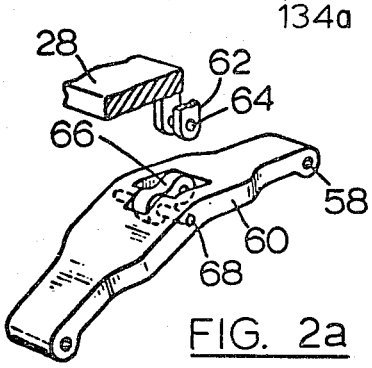
Figure 3:
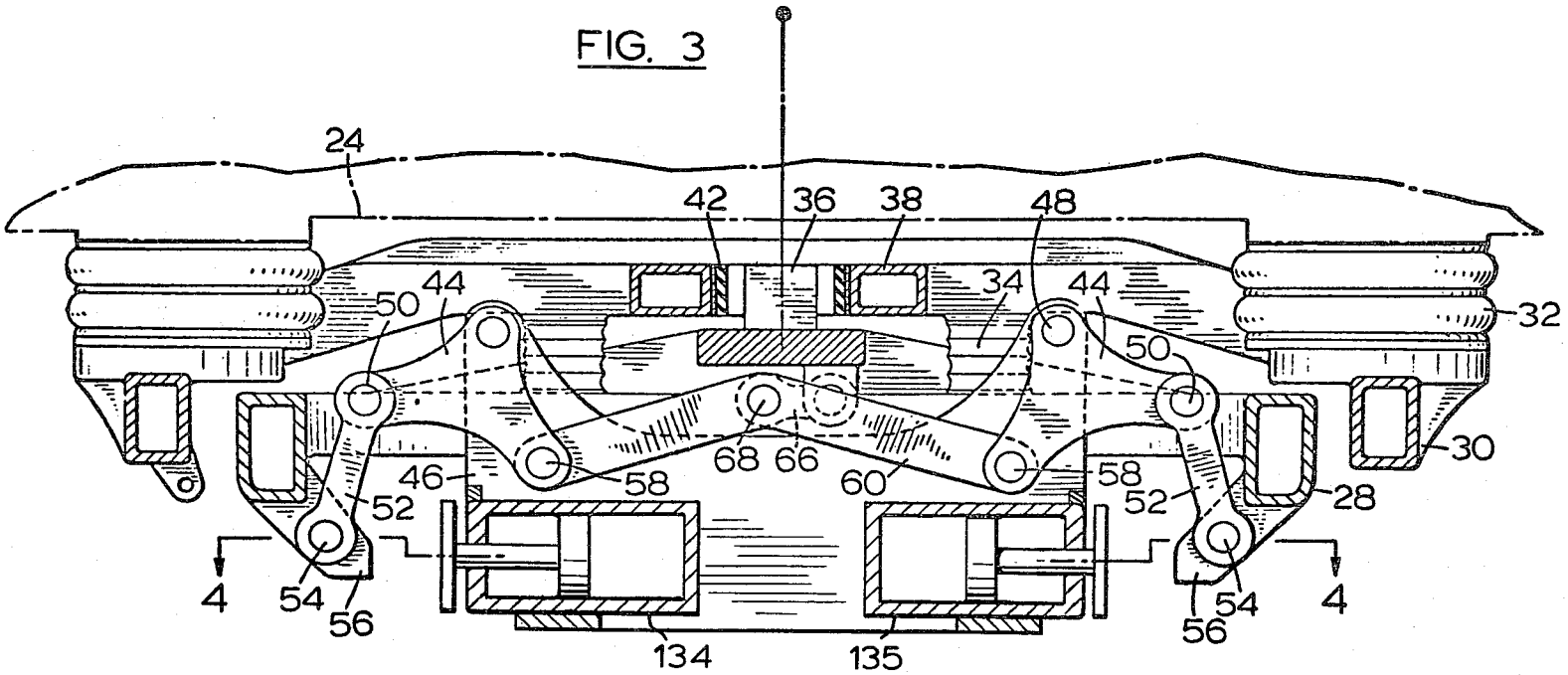
FIG. 3 is a section taken on the line 3—3 of FIG. 2 showing the safety device in retracted position.
Figure 4:
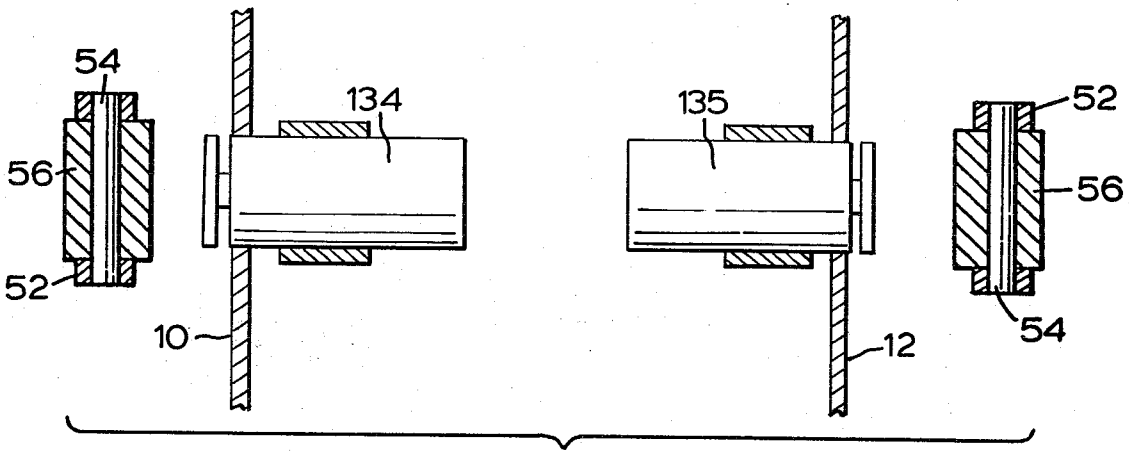
FIG. 4 is a section on the line 4—4 of FIG. 3.

If the lower member 28 is in a tilted condition, e.g. moved to the right as viewed in FIG. 2, one of the cylinders, in this case cylinder 135, will fully extend to the position shown in FIG. 5, in which its pad 135*a* is spaced from the adjacent pad 56. The other cylinder 134 will extend until the pad 134*a* abuts the respective lug 56. The suspension of the railway car 8 on the truck 9 is such that there is a tendency for the body to return to an upright position. As the car 8 returns to the upright position, the pad 134*a* will follow the lug 56 until the lower member is horizontal and the pad 135*a* abuts the respective lug 56. The check valve 140 prevents flow of fluid from the head end of the cylinders 134, 135 so that they act as rigid struts and hold the lower member 28 in a horizontal position.

The cylinders 134, 135 will remain in the extended locking condition until the condition detected by the sensor is normalized and pressure again exists in line 137 to retract the cylinders.

It will be seen, therefore, that a simple effective arrangement is provided which ensures that the car 8 is maintained in a stable condition upon detection of a fault. It will be appreciated that the safety circuit also operates when the car is taken out of service, resulting in a loss of electric power supply, and ensures that pressure has built up in the tilting circuit and accumulator 150 before the check valve 140 opens to retract the cylinders 134, 135.

Whilst a solenoid operated valve has been shown to control the safety circuit it is possible to utilize a pilot pressure operated valve which is connected directly to a suitable tap point in the tilt circuit such as the feed to the relief valve 122.

It will be seen therefore that a simple compact arrangement is achieved which reduces the space required by the safety device on the frame of the truck and operates in an efficient, simple manner.

We claim:

1. For use in a railway truck assembly comprising:

a frame;

at least two wheel and axle assemblies mounted by the frame and on which the vehicle runs;

a bolster member mounted on the frame and adapted to support a vehicle body thereon for pivoting and tilting movement relative to the frame;

mounting means connecting the bolster member and the frame for the said tilting movement of the bolster member relative to the frame;

first motor means connected between the bolster member and the frame and operative upon the supply of power thereto from a power source to produce the said tilting movement therebetween; and a safety device comprising hydraulic second motor means mounted by the frame and operable between a first condition in which it engages the bolster member to inhibit tilting thereof relative to the truck frame and a second condition in which said tilting is permitted; a control circuit for said hydraulic second motor means, said control circuit comprising a pressure line connected to a source of pressurized fluid, a return line connected to a sump for the pressurized fluid, a pair of hydraulic service lines connected to opposite sides of said hydraulic second motor means, valve means connected to said service lines and said pressure and return lines and operable in a first position to direct fluid from said pressure line to one of said service lines to move said motor means to said first condition and in a second position to direct fluid from said pressure line to the other of said services lines to cause said motor means to move to said second condition, control means to move said valve means between said first and second positions and a pressurized fluid reservoir connected to said pressure line and operable to supply pressurized fluid to said valve means whereby, upon movement of said valve means to said first position, said pressurized fluid reservoir supplies fluid to said one service line to move said motor means to said first condition.

2. A control circuit according to claim 1 wherein said pressurized fluid reservoir comprises a gas charged accumulator.

3. A control circuit according to claim 1 including a first check valve in said pressure line operable to prevent flow from said pressurized fluid reservoir to said pressure source.

4. A control circuit according to claim 3 including throttle means in said pressure line between said first check valve and said valve means, said pressurized fluid reservoir being connected to said pressure line intermediate said check valve and said throttle means.

5. A control circuit according to claim 1 wherein a check valve is provided in said one service line to prevent flow from said motor means to said valve means and pilot operating means are provided to open said check valve and permit such flow when said valve means is in said second position.

6. A control circuit according to claim 5 wherein said pilot operating means is responsive to pressure in said other line to open said check valve.

7. A control circuit according to claim 1 wherein said control means is responsive to attainment of a predetermined pressure in said pressure line to move said valve means between said first and second position.

8. A control circuit according to claim 7 wherein said control means includes springs means to bias said valve means to said first position and motor means to move said valve means against said spring means to said second position.

9. A control circuit according to claim 8 wherein said motor means is an electrical solenoid which is energized when pressure delivered by said pressure source exceeds a predetermined value.

10. For use in a railway truck assembly comprising:

a frame;

at least two wheel and axle assemblies mounted by the frame and on which the vehicle runs;

a bolster member mounted on the frame and adapted to support a vehicle body thereon for pivoting and tilting movement relative to the frame;

mounting means connecting the bolster member and the frame for the said tilting movement of the bolster member relative to the frame; and first motor means connected between the bolster member and the frame and operative upon the supply of power thereto from a power source to produce the said tilting movement therebetween;

a safety device comprising hydraulic second motor means mounted by the frame and operable between a first condition in which it engages the bolster member to inhibit tilting thereof relative to the truck frame and a second condition in which the said tilting is permitted; the safety device including a control circuit for said hydraulic second means, said control circuit comprising a pressure line connected to a source of pressurized fluid, a return line connected to a sump for the pressurized fluid, a pair of hydraulic service lines connected to opposite sides of said hydraulic second motor means, valve means connected to said service lines and said pressure and return lines and operable in a first position to direct fluid from said pressure line to one of said service lines to move said motor means to said first condition and in a second position to direct fluid from said pressure line to the other of said service lines to cause said motor means to move to said second condition, control means to move said valve means between said first and second positions and a pressurized fluid reservoir connected to said pressure line and operable to supply pressurized fluid to said valve means whereby, upon movement of said valve means to said first position, said pressurized fluid reservoir supplies fluid to said one service line to move said cylinder to said first condition, said pressurized fluid reservoir including a variable volume fluid receiving chamber and biasing means to reduce the volume of said chamber to a minumum.

11. A control circuit according to claim 10 wherein said biasing means comprises a gas filled chamber.

* * * * *